US006582061B2

(12) United States Patent
Sugioka

(10) Patent No.: US 6,582,061 B2
(45) Date of Patent: Jun. 24, 2003

(54) INK JET RECORDING HEAD AND INK JET RECORDING APPARATUS

(75) Inventor: Hideyuki Sugioka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/917,743

(22) Filed: Jul. 31, 2001

(65) Prior Publication Data

US 2002/0021332 A1 Feb. 21, 2002

(30) Foreign Application Priority Data

Aug. 4, 2000 (JP) ..... 2000-236887

(51) Int. Cl.[7] ..... B41J 2/05
(52) U.S. Cl. ..... 347/58; 347/61
(58) Field of Search ..... 347/9, 10, 56, 347/61, 62, 58, 63

(56) References Cited

U.S. PATENT DOCUMENTS 6,010,201 A * 1/2000 Shimoda ..... 347/7

FOREIGN PATENT DOCUMENTS

| | | | | |
|---|---|---|---|---|
| EP | 0 532 877 A2 | | 3/1993 | |
| EP | 0 995 600 A2 | | 4/2000 | |
| EP | 995 600 | * | 4/2000 | |
| JP | 57-36679 | | 2/1982 | |
| JP | 57-182452 | * | 11/1982 | ..... 347/71 |
| JP | 62-201254 | | 9/1987 | |
| JP | 64-20151 | | 1/1989 | |
| JP | 64-20152 | | 1/1989 | |
| JP | 5-185594 | | 3/1993 | |
| JP | 8-15629 | | 1/1996 | |

* cited by examiner

*Primary Examiner*—John Barlow
*Assistant Examiner*—Michael S. Brooke
(74) *Attorney, Agent, or Firm*—Fitzpatrick, Cella, Harper & Scinto

(57) ABSTRACT

An ink jet recording head comprises heating means for generating a heat energy to be utilized for discharging an ink, and a nonlinear element for driving the heating means, having MIM type current/voltage characteristics in which a resistance value during application of a low voltage indicates a high value regardless of polarity as compared with the resistance value during application of a high voltage, wherein the nonlinear element has an electric field relaxing structure for relaxing generation of a locally strong electric field.

17 Claims, 7 Drawing Sheets

MIM TYPE ELECTRICAL CHARACTERISTICS

INK JET RECORDING HEAD AND INK JET RECORDING APPARATUS

BACKGROUND OF THE INVENTION

1. Field of the Invention

The present invention relates to an ink jet recording head and ink jet recording apparatus for use in an ink jet printer, particularly in a bubble jet printer for utilizing a bubbling phenomenon to discharge an ink, and the like.

2. Description of the Related Art

A bubble jet recording system comprises: using a heating element to locally heat a liquid in a channel and generating a bubble; utilizing a high pressure generated during bubbling; pushing and discharging a liquid droplet from a microfine discharge port; and attaching the liquid droplet to a recording paper or another recording material to record an image. An ink jet recording head for use in recording the image by the bubble jet recording system generally includes a microfine discharge port, channel, and heating element disposed in the channel.

In order to use such ink jet recording head and record the image with a higher colorfulness, a technique of discharging the microfine liquid droplet with a high density is required. Therefore, it is basically important to form a microfine channel and heating source. Therefore, for the ink jet recording head of the bubble jet recording system, a method of utilizing simplicity of a head structure and fully using a photolithography technique to prepare a high-density head has been proposed (e.g., Japanese Patent Application Laid-Open No. 8-15629, and the like). Moreover, in order to adjust a discharge amount of liquid droplets so that microfine liquid droplets can be discharged, a heating element having a larger calorific value in a middle portion than in an end has been proposed (see Japanese Patent Application Laid-Open No. 62-201254).

As the heating element for use in the ink jet recording head, a tantalum nitride thin-film resistor with a thickness of about 0.05 $\mu$m is usually used, and liquid is bubbled by Joule heat generated during energizing of the resistor. In this resistance heating element, in order to usually prevent the surface of the resistance heating element from being damaged by cavitation, an anti-cavitation layer formed of Ta or another metal having a thickness of about 0.2 $\mu$m is disposed via SiN or another insulator having a thickness of about 0.8 $\mu$m.

Moreover, in Japanese Patent Application Laid-Open No. 64-20151, a so-called multi-nozzle ink jet recording head is disclosed in which a plurality of longitudinal and transverse wires are disposed on a substrate, a rectifier element for passing a forward current and thereby generating the heat is disposed in a plurality of intersections of the wires, and discharge ports are disposed in a matrix form. Furthermore, in Japanese Patent Application Laid-Open No. 57-36679, an ink jet recording head is disclosed in which a plurality of diodes are disposed as heating elements in the matrix form on the substrate. In the diode, heat can be generated by passing electricity in a forward direction, and electricity cannot be passed in a reverse direction.

Additionally, in Japanese Patent Application Laid-Open No. 5-185594, another ink jet recording head is disclosed. The head is constituted by disposing a diode, and an electrothermal conversion element connected to the diode and disposed as the heating element in the matrix form on a head substrate so that the electrothermal conversion element can selectively be driven, or is constituted by disposing a logic circuit constituted of a shift register portion, latch portion, and logic circuit, and the electrothermal conversion element connected to the logic circuit on the same substrate so that the electrothermal conversion element can selectively be driven.

SUMMARY OF THE INVENTION

In most of conventional ink jet recording heads, a heating element, diode, logic circuit portion, and the like are simultaneously constituted and manufactured on a silicon substrate by a semiconductor process (e.g., an ion injecting method). In the manufacturing method using such semiconductor process, when the ink jet recording head having a relatively small number of discharge ports is manufactured, a compact constitution can advantageously be manufactured in a single step. However, a so-called full multi-head has a length, for example, of 12 inches (about 30 cm), which extends over a full width of a recording paper. When a necessary element is integrally formed in such a broad range by the semiconductor process, it is difficult to use a usual silicon wafer. Therefore, when the full multi-head is manufactured using the semiconductor process, a manufacturing cost possibly increases.

Then, when a non-linear element able to be manufactured without using a conventional semiconductor process can be used to constitute the circuit for selectively driving heating elements disposed in a matrix form, a longitudinal ink jet recording head like a full multi-head can possibly be provided at a low cost.

As the nonlinear element, a metal insulator metal (MIM) element for conventional use in a liquid crystal is known. This is a nonlinear element having MIM type electrical characteristics in which a resistance value during application of a low voltage indicates a high value regardless of polarity as compared with the resistance value during application of a high voltage. When the MIM element is used in the liquid crystal, a power for generating a power density of about 1 $W/m^2$ is usually supplied. On the other hand, in the ink jet recording head of the bubble jet recording system, the power for generating a power density of about 0.1 $GW/m^2$ or more needs to be supplied to the heating element. Therefore, for use of the MIM element in selectively driving the heating element, a large amount of power which has not heretofore been supplied needs to be supplied to or via the MIM element.

When a voltage applied to the MIM element is increased, it is possible to increase the power supplied to or via the MIM element to some degree. However, the voltage applied to the MIM element having a constitution similar to the conventional constitution is increased, and then there is a fear that the MIM element is adversely affected by a strong electric field. Moreover, there is a fear that the MIM element itself is adversely affected by a temperature rise by the heat generated by the MIM element. There is a fear that the electric field or an electrical current is concentrated particularly in an edge portion or a step portion of an electrode pair of the MIM element and a remarkably high heat is locally generated. There is further fear that the MIM element is adversely affected by the locally generated heat.

An object of the present invention is to reduce an adverse effect onto the nonlinear element by the heat or the electric field generated during supply of a power for producing a large power density with respect to the nonlinear element for selectively driving heating elements disposed in a matrix form in an ink jet recording head of a bubble jet recording system.

Another object of the present invention is to use a nonlinear element in a circuit for selectively driving heating elements disposing in a matrix form so that a longitudinal ink jet head can be provided at a low cost.

To achieve the aforementioned objects, according to the present invention, there is provided an ink jet recording head comprising: heating means for generating a heat energy to be utilized for discharging an ink; and a nonlinear element for driving the heating means, having MIM type current/voltage characteristics in which a resistance value during application of a low voltage indicates a high value regardless of polarity as compared with the resistance value during application of a high voltage, wherein the nonlinear element has an electric field relaxing structure for relaxing generation of a locally strong electric field in the nonlinear element.

The nonlinear element having the MIM type electrical characteristics is used, and thereby the heating means disposed in the matrix form can selectively be driven with a relatively simple constitution in which the nonlinear element is disposed in an intersection of a vertical electrode and a transverse electrode and connected to both electrodes. That is, when voltages opposite to each other in polarity are applied to one of a plurality of vertical electrodes and one of a plurality of transverse electrodes in the circuit constituted as described above, an electrical current is passed only to the heating means in the intersection of the vertical and transverse electrodes, and the heating means can selectively be driven.

When the voltage is applied to the nonlinear element as described above, the electric field formed in the element does not necessarily become uniform, and the locally strong electric field is formed. To solve the problem, the nonlinear element includes the electric field relaxing structure for relaxing the locally strong electric field, and can therefore bear the formed electric field with a relatively high power density.

Moreover, the nonlinear element constituted as described above can preferably be used in selectively driving the heating means of the ink jet recording head, which needs to be driven by supply of a relatively high power. Furthermore, when the nonlinear element is used, the selectively driven heating means disposed in the matrix form can relatively simply be constituted as described above. Additionally, the nonlinear element can be manufactured without using a semiconductor process. Therefore, a relatively longitudinal ink jet recording head can be manufactured at a low cost.

Some of these nonlinear elements such as MIM element and varistor have a constitution in which a pair of electrodes are disposed opposite to each other. For the use of the nonlinear element constituted as described above, it is known that the locally strong electric field is formed in an outer periphery of an opposite portion of the pair of electrodes. The pair of electrodes are structured such that an interval between the pair of electrodes increases in the outer periphery of the opposite portion of the pair of electrodes. Thereby, a strength of the electric field in the outer periphery is weakened, and the locally strong electric field can be relaxed. That is, this structure can be formed as the electric field relaxing structure. Additionally, in the present invention, the outer periphery of the opposite portion of the pair of electrodes is a part of the nonlinear element.

Moreover, according to the present invention, there is provided an ink jet recording head comprising: heating means for generating a heat energy to be utilized for discharging an ink; and a nonlinear element for driving the heating means, having MIM type current/voltage characteristics in which a resistance value during application of a low voltage indicates a high value regardless of polarity as compared with the resistance value during application of a high voltage, wherein the nonlinear element has a pair of electrodes disposed opposite to each other, and an interval between the pair of electrodes is larger in an outer periphery of an opposite portion of the pair of electrodes than in any other portion of the opposite portion.

As the nonlinear element for use in the ink jet recording head of the present invention, an MIM element is preferably which comprises a lower electrode disposed on a substrate, an insulating thin film disposed on the lower electrode, and an upper electrode disposed on the insulating thin film.

When the MIM element is used, an insulating layer is disposed between the insulating thin film and the upper electrode, the insulating layer has a first hole via which the insulating thin film is exposed in the vicinity of a middle of the opposite portion and which is tapered downwards in the opposite portion of the upper and lower electrodes, and the upper electrode has a downward protrusion having a downward convex shape for engaging in the first hole.

The upper electrode has a downward protrusion having a downward convex shape for engaging in the first hole tapered downwards in the opposite portion of the upper and lower electrodes constituting the MIM element. In the constitution, the interval between the electrodes increases in the outer periphery of the opposite portion of the electrodes, and this structure functions as the electric field relaxing structure.

The nonlinear element itself can be used as the heating means. Particularly, when the nonlinear element is the MIM element having the insulating layer as described above, a channel for introducing an ink to the vicinity of the MIM element, and a discharge port for discharging the ink can be disposed on the MIM element. In the constitution, when a depth of the first hole is adjusted, a distance between the discharge port and the MIM element can be adjusted to be adequate.

Moreover, a resistance heating element connected in series with the nonlinear element may be disposed as the heating means. In this case, particularly when the nonlinear element is the MIM element having the insulating layer as described above, a second hole for exposing a part of the substrate is formed in the insulating layer, and the upper electrode is extended downwards onto the substrate along the second hole. Moreover, the resistance heating element is connected to the upper electrode and disposed in this portion, and a channel for introducing an ink to the vicinity of the resistance heating element and a discharge port for discharging the ink can be disposed on the resistance heating element. In this constitution, when the depth of the second hole is adjusted, the distance between the discharge port and the MIM element can be adjusted to be adequate.

Moreover, the resistance heating element may be connected to the upper electrode and disposed on the insulating layer. In this case, the insulating layer functions as a heat accumulating layer of the resistance heating element. Therefore, temperature in the vicinity of the resistance heating element is effectively raised, and a discharged liquid can efficiently be bubbled. Furthermore, since the insulating layer is disposed between the resistance heating element and the substrate, temperature rise of the substrate by heat generation of the resistance heating element is inhibited, the heating of the MIM element disposed on the substrate is inhibited, and adverse effect by the heating can be reduced.

Additionally, the resistance heating element may be connected to the lower electrode, disposed on the substrate, and coated with the insulating layer. In this case, since the insulating layer functions as a protective layer of the resistance heating element, it is unnecessary to dispose a new protective layer.

The nonlinear element having the MIM type current/voltage characteristics for use in the ink jet recording head according to the present invention can preferably be used in selectively driving the heating means disposed in the matrix form as described above. Therefore, the present invention can preferably be applied to the ink jet recording head having a matrix electrode constituting a matrix circuit for applying the voltage to the heating means. Moreover, since the nonlinear element is disposed in the intersection of the matrix electrodes, the heating means disposed in the matrix form can preferably selectively be driven.

The present invention can preferably be applied to the ink jet recording head in which film boiling is caused in the ink by the heat energy and the ink is discharged.

Moreover, according to the present invention, there is provided an ink jet recording head comprising: heating means for generating a heat energy to be utilized for discharging an ink; and a nonlinear element for driving the heating means, having MIM type current/voltage characteristics in which a resistance value during application of a low voltage indicates a high value regardless of polarity as compared with the resistance value during application of a high voltage, wherein the nonlinear element comprises an insulating thin film, and a pair of electrodes disposed opposite to each other via the insulating thin film, and at least a portion of the pair of electrodes in contact with the ink is formed of a chemically stable conductor.

Thereby, even when the electrode constituting the MIM element contacts the ink, the electrode can be prevented from being damaged by an electrochemical action.

According to the present invention, there is provided an ink jet recording apparatus comprising: at least the aforementioned ink jet recording head in which an ink discharge port for discharging an ink is disposed opposite to a recording surface of a recording material; and conveying means of the recording material.

DESCRIPTION OF THE PREFERRED EMBODIMENTS

Embodiments of the present invention will be described hereinafter with reference to the drawings.

(First Embodiment)

Figure 1:
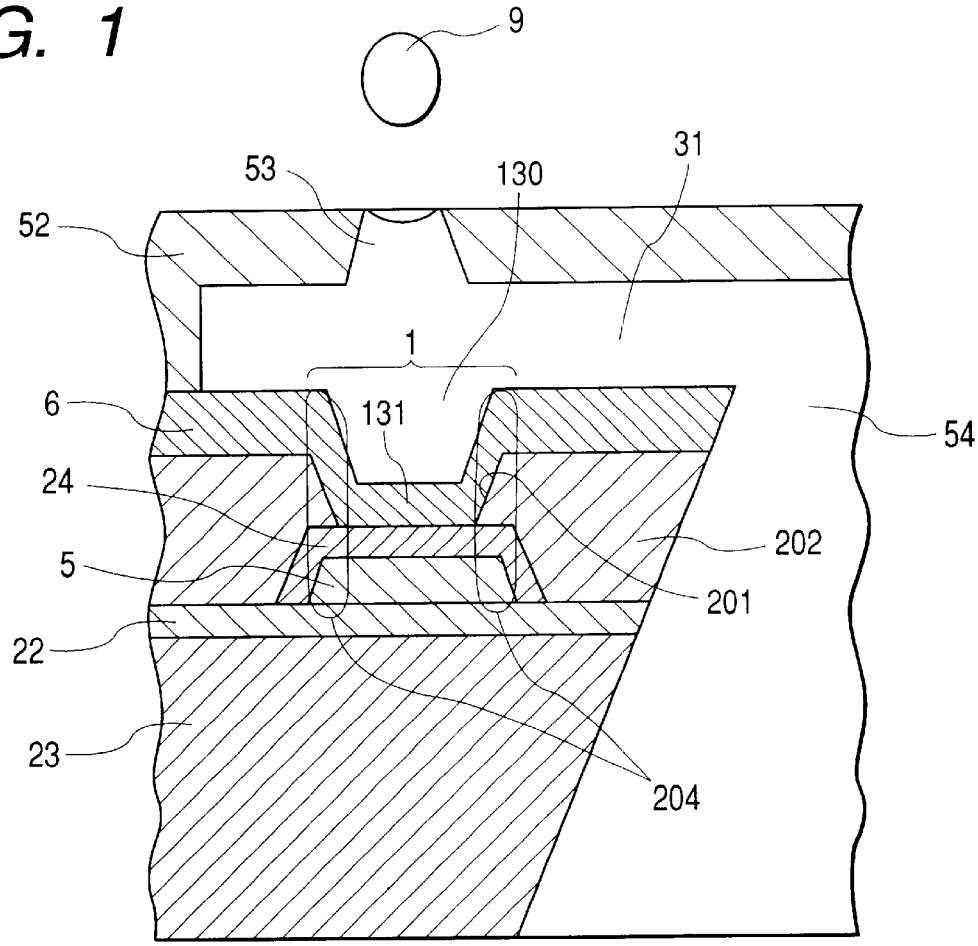
FIG. 1 is a schematic sectional view of an ink jet recording head according to a first embodiment of the present invention.
Figure 2:
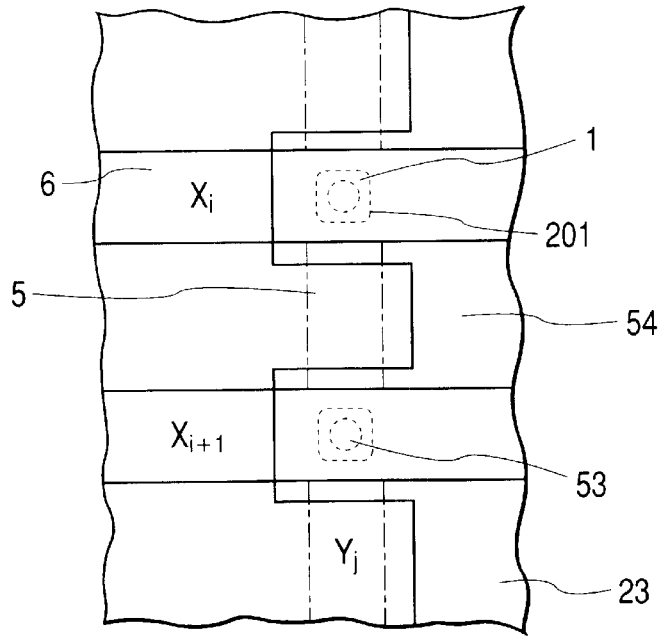
FIG. 2 is a schematic plan view of the ink jet recording head of FIG. 1.
Figure 3:
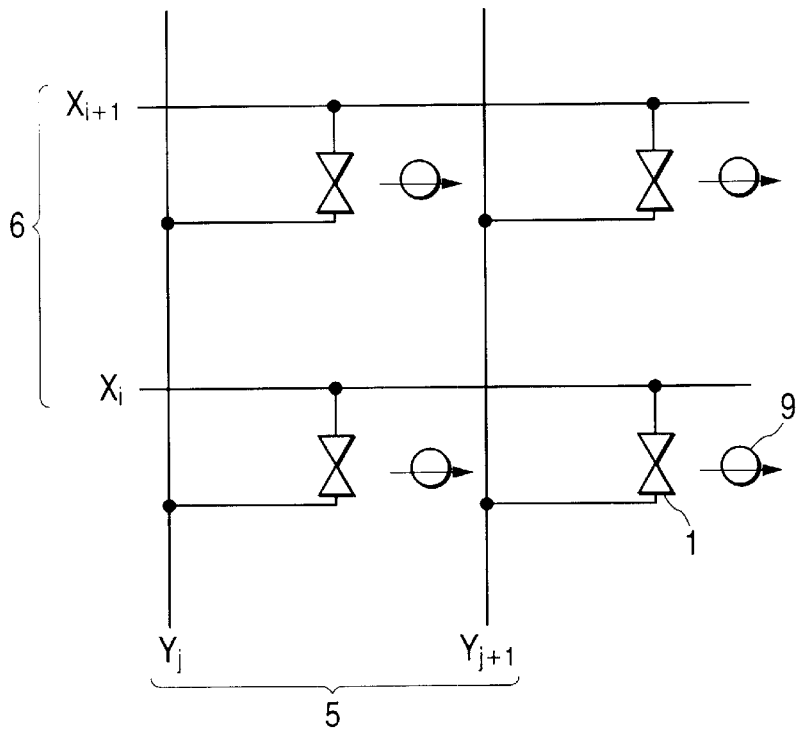
FIG. 3 is a schematic circuit diagram of the ink jet recording head of FIG. 1.

FIGS. 1 to 3 show schematic views of an ink jet recording head according to a first embodiment of the present invention. FIG. 1 shows a partial sectional view in the vicinity of a MIM element 1. FIG. 2 shows a partial plan view. FIG. 3 shows a schematic circuit diagram of a part including the MIM element 1. Additionally, FIG. 2 shows only a part of a discharge port forming member 52. FIG. 3 shows a discharged liquid droplet 9, and thereby shows that the MIM element 1 is an element for generating a heat in order to discharge the discharged liquid droplet 9.

In this ink jet recording head, a plurality of lower electrodes (vertical electrodes) 5 coated with remarkably thin insulating thin films 24 are vertically arranged on a substrate 23 having a lower layer 22 formed on an upper surface thereof. An insulating layer 202 is formed on the substrate 23 on which the lower electrode 5 is disposed. A first hole 201 is opened in the insulating layer 202 in which a middle portion of the lower electrode 5 in a width direction is exposed. The first holes 201 are arranged at predetermined intervals in a length direction of the lower electrode 5, transversely arranged with respect to a plurality of lower electrodes 5, and entirely opened in a matrix form. For a planar shape, the first hole 201 has a rectangular shape having rounded corners, and is tapered downwards.

On the insulating layer 202, a plurality of upper electrodes (transverse electrodes) 6 pass above the first holes 201 and are transversely arranged. The upper electrode 6 has a downward protrusion 131 having a downward convex shape, engages in a position of the first hole 201, and contacts the insulating thin film 24 of the lower electrode 5 in this portion. Thereby, in this portion, the MIM element 1 is formed of the lower electrode 5, upper electrode 6, and insulating thin film 24 disposed between both electrodes. Here, the MIM element 1 includes a portion in which the lower electrode 5 is disposed opposite to the upper electrode 6 via the insulating thin film 24 and insulating layer 202 as shown in FIG. 1. Moreover, as long as an interval between the lower electrode 5 and the upper electrode 6 increases in an outer periphery of the MIM element 1, the insulating thin film 24 may be formed integrally with the insulating layer 202.

A discharged liquid supply port 54 for introducing a discharged liquid supplied from a discharged liquid supply system (not shown) onto the substrate 23 is formed in the vicinity of each MIM element 1 in the substrate 23 in which the MIM elements 1 are formed in the matrix form as described above. Moreover, the discharge port forming member 52 including a plurality of grooves and holes is disposed on the substrate 23. These grooves and holes are formed for the respective MIM elements 1, each groove constitutes a channel 31 for introducing the discharged liquid supplied from the discharged liquid supply port 54 to the vicinity of each MIM element 1, and each hole forms a discharge port 53 for discharging the liquid. When the downward protrusion 131 of the upper electrode 6 is viewed from above, a first depressed area 130 constitutes a part of the channel 31. When a depth of the first hole 201 is adjusted to adjust the depth of the first depressed area 130, a distance between the MIM element 1 and the discharge port 53 can be adjusted to be adequate.

An operation of the ink jet recording head will next be described.

First, the channel 31 is filled with the discharged liquid introduced from discharged liquid supply means (not shown) via the discharged liquid supply port 54. When a predetermined voltage is applied between the lower electrode 5 and the upper electrode 6 by voltage applying means (not shown) in this state, an electrical current flows through the MIM element 1, and the MIM element 1 generates a heat. When the MIM element 1 generates the heat, the liquid in the vicinity of the MIM element 1 is heated and bubbled. The discharged liquid is pushed out of the discharge port 53 by a pressure generated at this time, and the discharged liquid droplet 9 is discharged. When the discharged liquid droplet 9 is attached to a recording material, an image is recorded.

The MIM element 1 is a nonlinear element having MIM type electrical characteristics. The element indicates a low resistance value regardless of polarity when a high voltage is applied, and indicates a high resistance value when a low voltage is applied. A voltage of $+V_0/2$ is applied, for example, to a j-th electrode $Y_j$ as one of the lower electrodes 5, and a voltage of $-V_0/2$ is applied, for example, to an i-th electrode $X_i$ as one of the upper electrodes 6. A voltage $V_0$ for generating the electrical current and generating a sufficient heat is applied to the MIM element positioned in an intersection of the electrodes $X_i$ and $Y_j$ among the MIM elements 1 disposed in the matrix form so that the MIM element can selectively be driven. In this case, a voltage $(V_0/2)$ lower than the voltage $V_0$ is applied to the other MIM elements 1 constituted by the electrode $X_i$ or $Y_j$. However, as described above, the MIM element 1 indicates a large resistance when the low voltage is applied. Therefore, the electrical current hardly flows through the other elements and no heat is generated.

Figure 4:
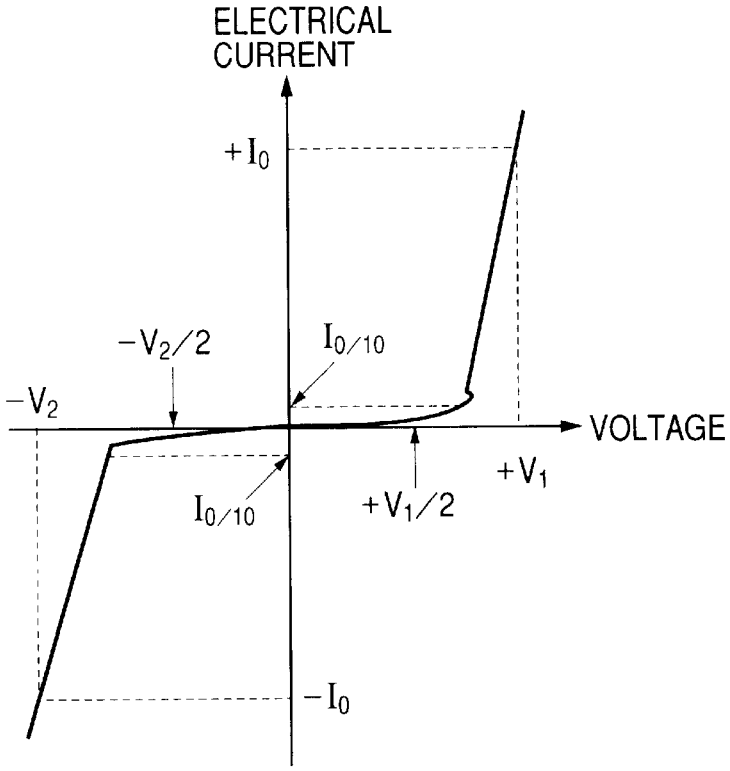
FIG. 4 is a graph showing preferable MIM type electrical characteristics.

FIG. 4 shows preferable MIM type electrical characteristics for satisfactorily selectively driving the MIM element. As shown in FIG. 4, in the electrical characteristics of the MIM element 1, a ratio $(V_1/V_2)$ of absolute values of voltages $+V_1$ and $-V_2$ applied to the MIM element 1 for providing an absolute value $I_0$ of the electrical current flowing through the heating element preferably indicates a value of 0.5 to 2 when a heat energy necessary for bubbling the discharged value is generated. Moreover, the absolute value of the electrical current flowing through the MIM element 1 is preferably $I_0/10$ or less when voltages of $+V_1/2$, $-V_2/2$ are applied. Typical examples of the element having the MIM type electrical characteristics include the MIM element, further a varistor, and the like.

In the present embodiment, the MIM element 1 disposed in the matrix form is selectively driven by using the upper electrode 6 as an information-side electrode, applying the voltage to the upper electrode in accordance with image information, using the lower electrode 5 as a scanning-side electrode, and applying a scanning voltage to the lower electrode. That is, first the voltage is applied to the upper electrode 6 of $X_i$ in the position in which a pixel is to be formed in a row $Y_1$ in accordance with image information, and simultaneously the voltage is applied to the lower electrode 5 of $Y_1$. Thereby, the MIM element selected from the MIM elements 1 of the row $Y_1$ is driven to discharge the discharged liquid droplet 9. That is, the discharged liquid droplet 9 is discharged from the discharge port 53 which needs to discharge the discharged liquid droplet 9 in accordance with the image information, and prevented from being discharged from the remaining discharge ports 53. The MIM element is selectively driven in this manner, and the image is recorded with respect to this row. Subsequently, the MIM element is similarly selectively driven with respect to a row $Y_2$. This is repeated to selectively drive all the MIM elements 1.

In the ink jet recording head of the first embodiment, when the voltage is selectively applied to the lower electrode 5 and upper electrode 6 in this manner, the MIM elements 1 arranged in the matrix form can selectively be driven. Therefore, a driver portion for controlling the selective driving can be disposed separately from the portion in which the MIM elements 1 are arranged in the matrix form, that is, a heating element group portion. It is unnecessary to form the driver portion in the ink jet recording head, and a head constitution can therefore be simplified. Moreover, the MIM element 1 can be manufactured without using an Si substrate or a semiconductor process. Therefore, for the ink jet recording head of the present embodiment, even a longitudinal head such as a full multi-head can easily be produced in large quantities using an inexpensive non-Si substrate, and can be manufactured at a low cost.

A manufacturing method of the ink jet recording head according to the first embodiment will next be described.

An Si substrate having a crystallographic axis (111) and a thickness of about 0.625 mm was used as the substrate 23. An Si thermally oxidized film with a thickness of about 2.75 $\mu$m was formed as the lower layer 22 on the substrate 23. Subsequently, a Ta thin film with a thickness of about 300 nm was formed as the lower electrode 5 on the lower layer 22 in an Ar gas atmosphere of about $10^{-2}$ Torr (1.3 Pa) by a high frequency (RF) sputtering method. Subsequently, a meshed platinum electrode was used as a cathode in an aqueous solution of about 0.8 wt % of citric acid to oxidize the lower electrode 5 by an anodizing method, and a $Ta_2O_5$ thin film with a thickness of about 32 nm was formed as the insulating thin film 24 on the surface of the electrode. Subsequently, a photosensitive polyimide layer with a thickness of about 2 $\mu$m was formed as the insulating layer 202, patterned, and subsequently calcined at about 350° C. for ten minutes. Subsequently, a tantalum thin film with a thickness of about 23 nm was formed as the upper electrode 6 by the RF sputtering method similarly as the lower electrode 5. Since the lower electrode 5 is anodized, the insulating thin film 24 is formed, and the upper electrode 6 is intersected and formed, a plurality of MIM elements 1 arranged in the matrix form can easily be manufactured.

For the planar shape, the MIM element 1 has a substantially square shape with a size of about 65.08 $\mu$m×about 65.08 $\mu$m. Therefore, an area of the MIM element 1 is about 4235 $\mu m^2$. When a voltage of about 33.5 V was applied between the lower electrode 5 and the upper electrode 6, an element resistance was about 265 Ω. That is, when the voltage of about 33.5 V was applied, an electrical current of about 126 mA flowed through the MIM element 1, and an electric field with a power density of 1 $GW/m^2$ was formed in the MIM element 1. In this case, a power consumption of the MIM element was about 4.235 W, the power was converted to heat, and it was possible to satisfactorily heat and bubble the discharged liquid.

Figure 10:
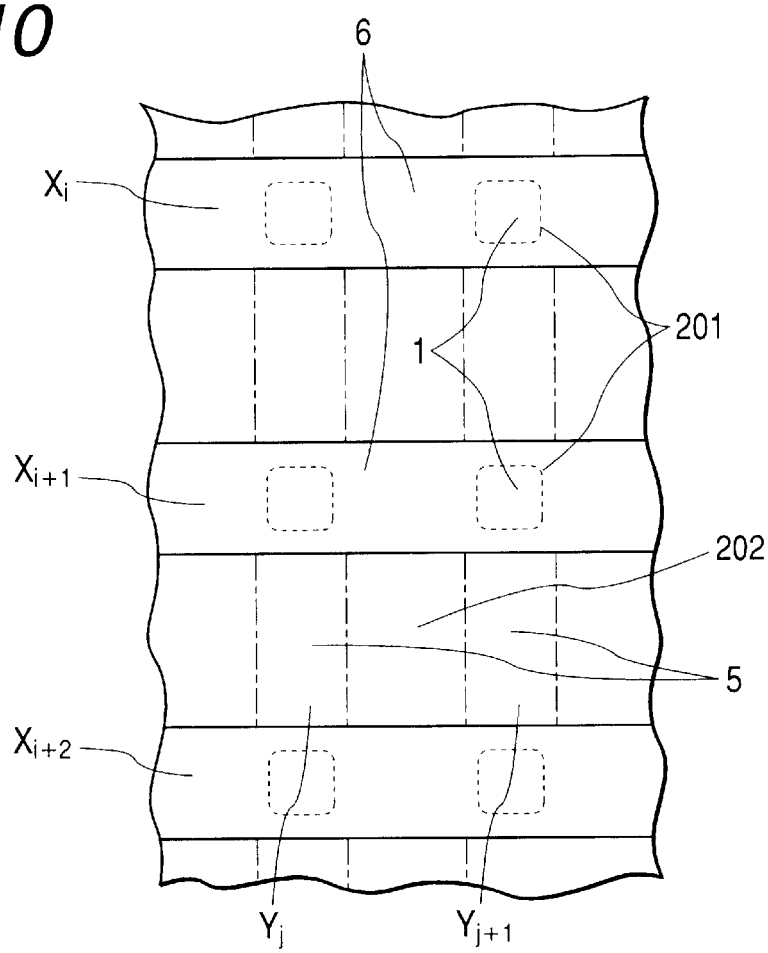
FIG. 10 is a schematic plan view of the ink jet recording head according to a modification example of the first embodiment.

Additionally, in the first embodiment, tantalum was used as a material of the electrode constituting the MIM element, that is, the lower and upper electrodes 5, 6. However, it is preferable to use chemically stable conductors such as platinum, gold and an alloy of these metals in at least a portion of the electrode constituting the MIM element in contact with an ink. Therefore, even when the electrode constituting the MIM element contacts the ink, the electrode can be prevented from being damaged by an electrochemical action. For example, it is considered that platinum is used as the material of the upper electrode 6 in the ink jet recording head shown in the plan view of FIG. 10. Moreover, in the ink jet recording head of the first embodiment shown in FIGS. 1 and 2, since the upper electrode 6 contacts the ink, platinum is considered to be used as the material of the upper electrode 6.

A structure of electric field relaxing means will next be described as a characteristic of the MIM element 1 of the ink jet recording head according to the first embodiment.

In general, when two planar electrodes are disposed opposite to and in parallel with each other, and the voltage is applied between both electrodes, a strong electric field different from a substantially uniform electric field in a middle portion is generated in an outer periphery of the electrode. When such strong electric field is generated, a large amount of heat is locally generated in the portion. There is a fear that the element is adversely affected.

To solve the problem, in the MIM element 1 of the ink jet recording head according to the first embodiment, the first hole 201 tapered downwards is formed in the insulating layer 202, and the downward protrusion 131 for engaging in the first hole 201 is disposed on the upper electrode 6 in the position in which the lower electrode 5 is disposed opposite to the upper electrode 6. This constitutes a structure (electric field relaxing structure 204) in which an interval between both electrodes increases in the outer periphery of the opposite portion of the lower and upper electrodes 5, 6. In this structure, a locally strong electric field generated in the outer periphery of the opposite portion of the lower and upper electrodes 5, 6 is relaxed, and local heat generation of the MIM element 1 can be relaxed. Thereby, the locally strong electric field, and accompanying locally generated heat are inhibited, and the MIM element 1 can be inhibited from being adversely affected.

In the first embodiment, for the structure for relaxing the locally strong electric field, the first through hole 201 is tapered as described above, but the first through hole 201 may be straight. Even in this case, the locally strong electric field can be relaxed.

Moreover, in the first embodiment, the downward protrusion 131 having a downward convex shape is disposed in the upper electrode 6, but an upward protrusion having an upward convex shape may be formed in the lower electrode 5. Furthermore, a vertical sectional shape of the downward protrusion 131 of the upper electrode 6 is linearly tapered and narrowed toward a bottom, but the shape is not limited to this. For example, for a three-dimensional shape of the downward protrusion 131, various shapes including curves may be formed in order to minimize generation of the locally strong electric field in an edge or another portion. Therefore, the three-dimensional shape of the downward protrusion 131 is preferably formed such that the generation of the strong electric field can be inhibited. In this case, an effect of inhibiting the generation of the locally strong electric field can further be enhanced.

The planar shape of the downward protrusion 131 of the upper electrode 6 for forming a liquid chamber above the MIM element 1 is determined in accordance with the planar shape of the first hole 201. The planar shape of the downward protrusion 131 of the upper electrode 6 is preferably symmetric so that a bubble having a symmetric shape is generated by the MIM element 1 and the discharged liquid droplet 9 is satisfactorily discharged. Therefore, the planar shape of the first hole 201 is preferably symmetric. Moreover, when the planar shape of the first hole 201 has a corner, the corner is formed in an electric field generation portion, the locally strong electric field is easily generated in this portion, and therefore the planar shape of the first hole 201 preferably has no corner. In the first embodiment, the planar shape of the first hole 201 is a rectangle having rounded corners, but a circular shape, and the like are also preferable.

Moreover, when a size of the first hole 201 is adjusted, an area of the electric field generation portion, that is, the area of the heating portion can be adjusted. In a narrow range, heat can be generated, and the discharged liquid can efficiently be heated and bubbled.

(Second Embodiment)

Figure 5:
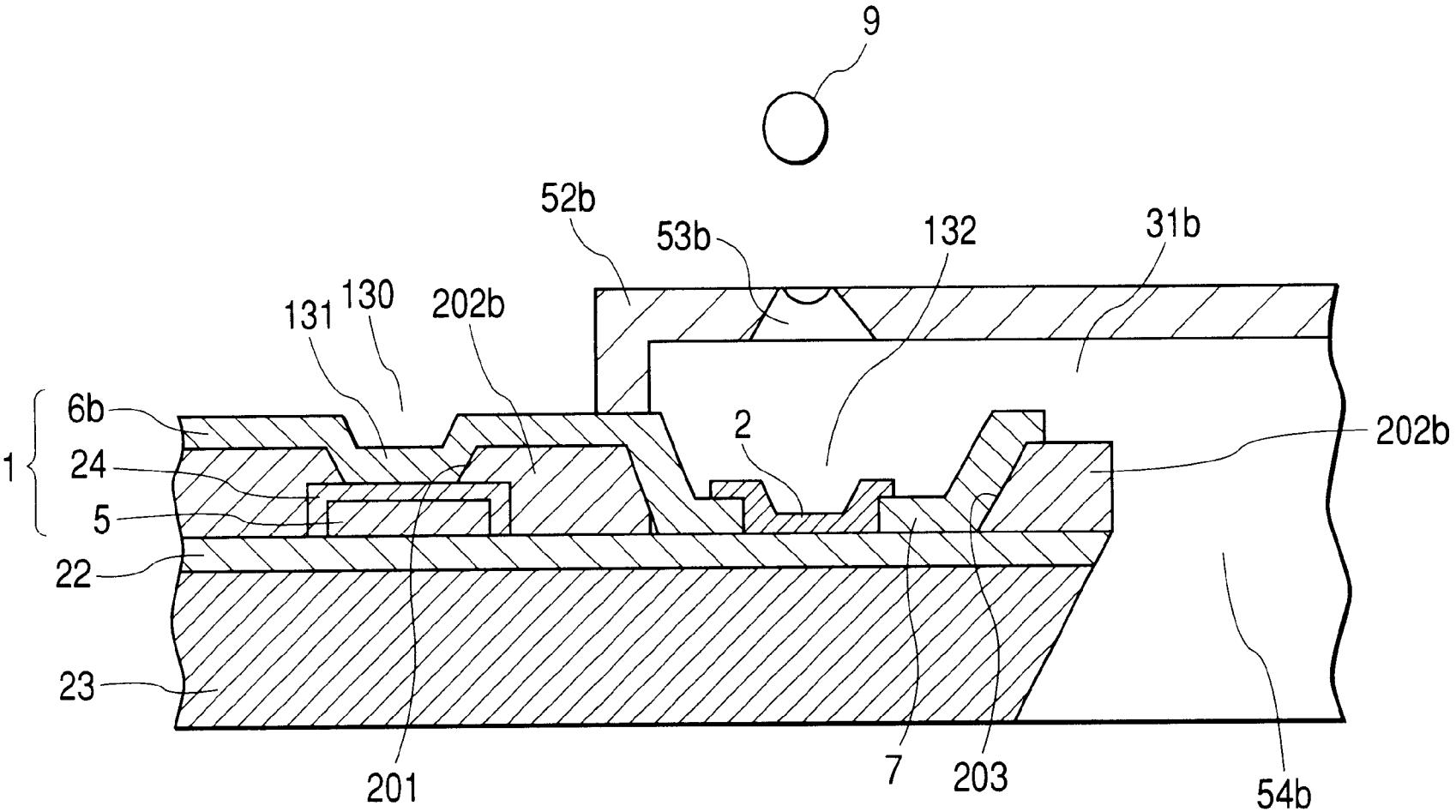
FIG. 5 is a schematic sectional view of the ink jet recording head according to a second embodiment.
Figure 6:
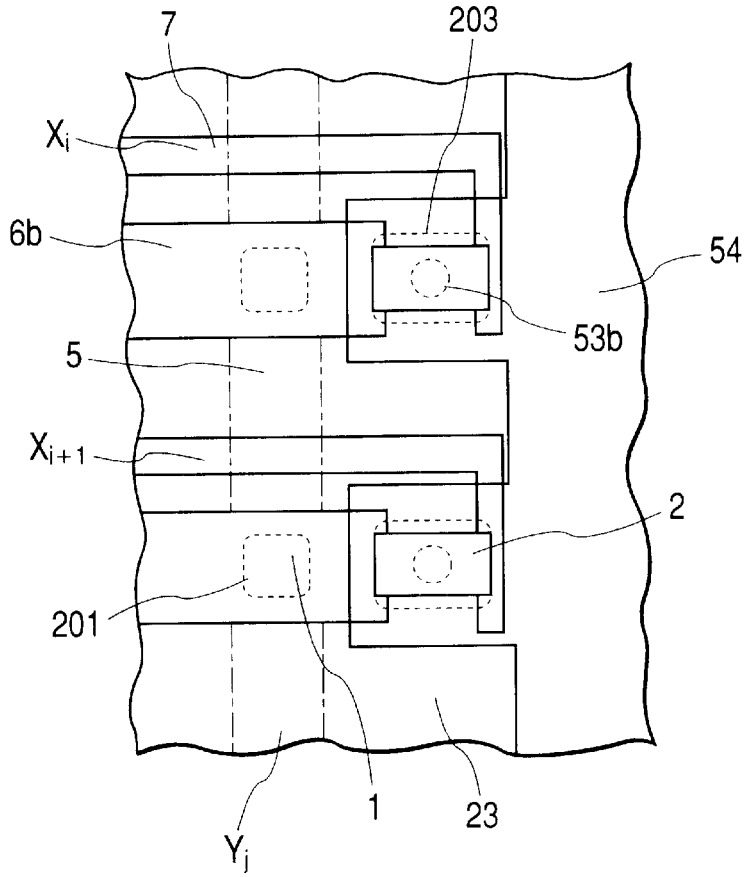
FIG. 6 is a schematic plan view of the ink jet recording head of FIG. 5.
Figure 7:
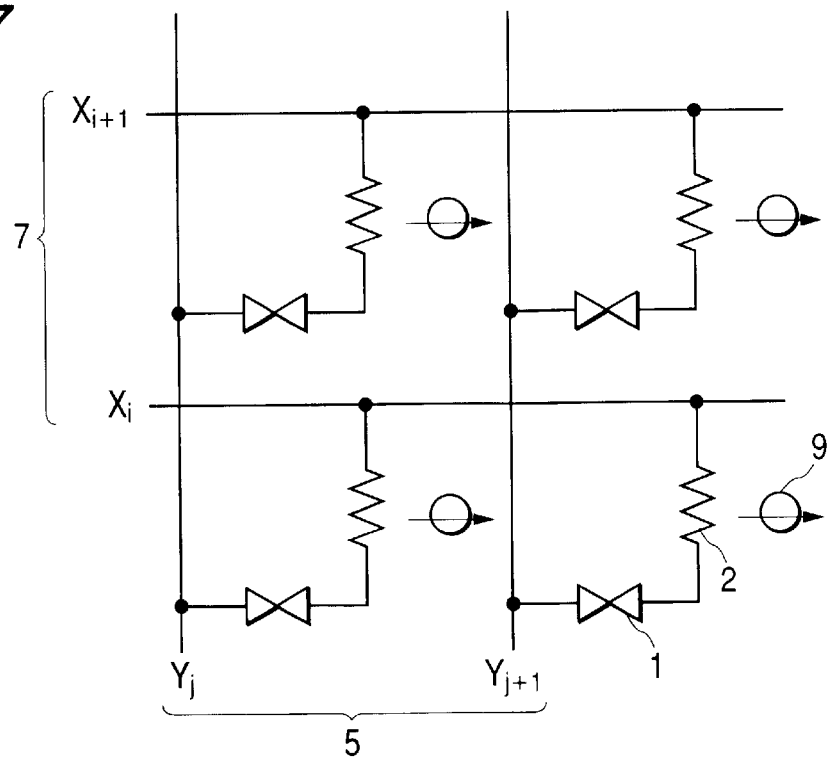
FIG. 7 is a schematic circuit diagram of the ink jet recording head of FIG. 5.

FIGS. 5 to 7 show schematic views of the ink jet recording head according to a second embodiment of the present invention. FIG. 5 is a partial sectional view in the vicinity of the MIM element 1. FIG. 6 shows a partial plan view. FIG. 7 shows a schematic circuit diagram of a part including the MIM element 1. Additionally, FIG. 6 shows only a part of a discharge port forming member 52*b*. FIG. 7 shows the discharged liquid droplet 9, and thereby shows that a resistance heating element 2 is an element for generating the heat in order to discharge the discharged liquid droplet 9. In these drawings, components similar to those of the first embodiment are denoted with the same reference numerals, and description thereof is omitted.

In the ink jet recording head of the second embodiment, the resistance heating element 2 connected in series with the MIM element 1 having a constitution substantially similar to the constitution of the first embodiment is used as heating means for bubbling the discharged liquid.

In addition to the first hole 201 for forming the downward protrusion 131 on an upper electrode 6*b* and bringing the protrusion in contact with the lower electrode 5 to form the MIM element 1, a second hole 203 for disposing the resistance heating element 2 is formed in an insulating layer 202*b*. The upper electrode 6*b* extends toward the second hole 203 from a portion constituting the MIM element 1, and extends to a middle portion (bottom) of the second hole 203 along the second hole. An information-side electrode 7 extending onto the insulating layer 202*b* from the bottom of the second hole 203 along a side wall of the hole in a position disposed opposite to a portion with the upper electrode 6*b* formed thereon on the inner surface of the second hole 203. As viewed in a planar mode, the information-side electrode 7 further comprises a portion extending in parallel to the lower electrode 5, and a portion common with each resistance heating element 2 of a row $X_i$ connected to the parallel extending portion and extending in a direction intersecting the lower electrode 5.

The resistance heating element 2 connected to the upper electrode 6*b* and information-side electrode 7 is formed between both electrodes in the middle portion of the bottom of the second hole 203. A discharged liquid supply port 54*b* is formed in the vicinity of each resistance heating element 2 in the substrate 23. An discharge port forming member 52*b* having a plurality of holes and grooves is disposed on the substrate 23. Thereby, a discharge port 53*b* is formed opposite to the resistance heating element 2, and a channel 31*b* connected to the discharge port 53*b* from the discharged liquid supply port 54*b* is formed.

A second depressed area 132 having a dent shape as viewed from above is formed by the second hole 203 above the resistance heating element 2. In this case, when a depth of the second depressed area 132 is adjusted, a distance between the resistance heating element 2 and the discharge port 53*b* can be adjusted to be adequate. The planar shape of the second depressed area 132 is preferably symmetric so that the bubble having a symmetric shape is generated by the resistance heating element 2 and the discharged liquid droplet 9 is satisfactorily discharged. In the second embodiment, the area has a rectangular shape with rounded corners.

In the second embodiment, the resistance heating elements 2 arranged in the matrix form can selectively be driven by applying the voltage to the information-side electrode 7 and lower electrode 5. That is, the electrical current flows through the resistance heating element 2 connected to the information-side electrode 7 and lower electrode 5 with the voltage applied thereto via the MIM element 1, and the resistance heating element 2 is selectively driven. In this case, for the resistance heating element 2 in which the voltage is applied to only one of the connected information-side electrode 7 and lower electrode 5, only a small voltage is applied to the MIM element 1 connected to the resistance heating element 2, the electrical current therefore hardly flows, and the element is not driven. In the second embodiment, the voltage is applied to the information-side electrode 7 in accordance with image information, the lower electrode 5 is used as a scanning-side electrode, a voltage for scanning is applied to the lower electrode, and the lower electrode is selectively driven.

A manufacturing method of the ink jet recording head according to the second embodiment will next be described.

An Si substrate having a crystallographic axis (111) and a thickness of about 0.625 mm was used as the substrate 23. An Si thermally oxidized film with a thickness of about 2.75 $\mu$m was formed as the lower layer 22 on the substrate 23. Subsequently, a Ta thin film with a thickness of about 300 nm was formed as the lower electrode 5 on the lower layer 22 in the Ar gas atmosphere of about $10^{-2}$ Torr (1.3 Pa) by the high frequency (RF) sputtering method. Subsequently, a meshed platinum electrode was used as a cathode in the aqueous solution of about 0.8 wt % of citric acid to oxidize the lower electrode 5 by the anodizing method, and a $Ta_2O_5$ thin film with a thickness of about 32 nm was formed as the insulating thin film 24. Subsequently, a photosensitive polyimide layer with a thickness of about 2 $\mu$m was formed as the insulating layer 202*b*, patterned, and subsequently calcined at about 350° C. for ten minutes. Subsequently, a tantalum thin film with a thickness of about 23 nm was formed as the upper electrode 6*b* and information-side electrode 7 by the RF sputtering method similarly as the lower electrode 5. Moreover, a tantalum nitride thin-film with a thickness of about 0.05 $\mu$m was formed as the resistance heating element 2. When the lower electrode 5 is anodized to form the insulating thin film 24 and the upper electrode 6*b* is intersected and formed on the thin film, a plurality of MIM elements 1 arranged in the matrix form can easily be manufactured.

In the second embodiment, the resistance heating element 2 was formed in a substantially square shape with a size of 25 $\mu$m×25 $\mu$m and an area of about 625 $\mu m^2$. The element resistance of the resistance heating element 2 was 53 Ω. The MIM element 1 was formed in a substantially rectangular shape with a size of 84.5 $\mu$m×20000 $\mu$m and an area of about 1690000 $\mu m^2$. In the second embodiment, the area of the MIM element 1 was set to be large in this manner in order to minimize an unnecessary temperature rise. The area of the MIM element 1 is about 2704 times the area of the resistance heating element 2. When a voltage of 6.7 V was applied between the lower electrode 5 and the upper electrode 6*b*, the element resistance of the MIM element 1 was 53 Ω.

In the second embodiment, when a voltage of about 13.4 V is applied between the lower electrode 5 and the information-side electrode 7, a voltage of about 6.7 V is applied to each of the MIM element 1 and resistance heating element 2, an electrical current of about 126 mA is passed, and the resistance heating element 2 can thereby generate the heat.

In this case, power consumption of the MIM element 1 and resistance heating element 2 is about 0.847 W, and the consumed power is converted to heat. The power density of the electric field generated in the MIM element 1 is about 0.5 $MW/m^2$, and the power density of the electric field generated in the resistance heating element 2 is about 1.355 $GW/m^2$. Thereby, the heat sufficient for heating and bubbling the discharged liquid can be generated in the portion including the resistance heating element 2. On the other hand, the heat is generated also in the portion including the MIM element 1, but a calorific value per unit area is small as about 1/2704 of the calorific value per unit area of the resistance heating element 2, and a temperature rise can be minimized.

In the second embodiment, the ink jet recording head has been described in which the MIM element 1 is not used as the heating element, but is used in a selective driving circuit of the resistance heating element 2 disposed in the matrix form. Even the constitution of the ink jet recording head can relatively be simplified as described above, and can be manufactured without using the semiconductor process. Therefore, similarly as the first embodiment, even the longitudinal head such as the full multi-head can easily be produced in large quantities using the non-Si substrate, and can advantageously be manufactured at a low cost.

Moreover, for the MIM element 1 used in the second embodiment, by the constitution in which the interval between the lower electrode 5 and the upper electrode 6 increases in the outer periphery of the opposite portion of the electrodes, the locally strong electric field, and the accompanying locally generated heat are inhibited. This can inhibit the MIM element 1 from being adversely affected.

(Third Embodiment)

Figure 8:
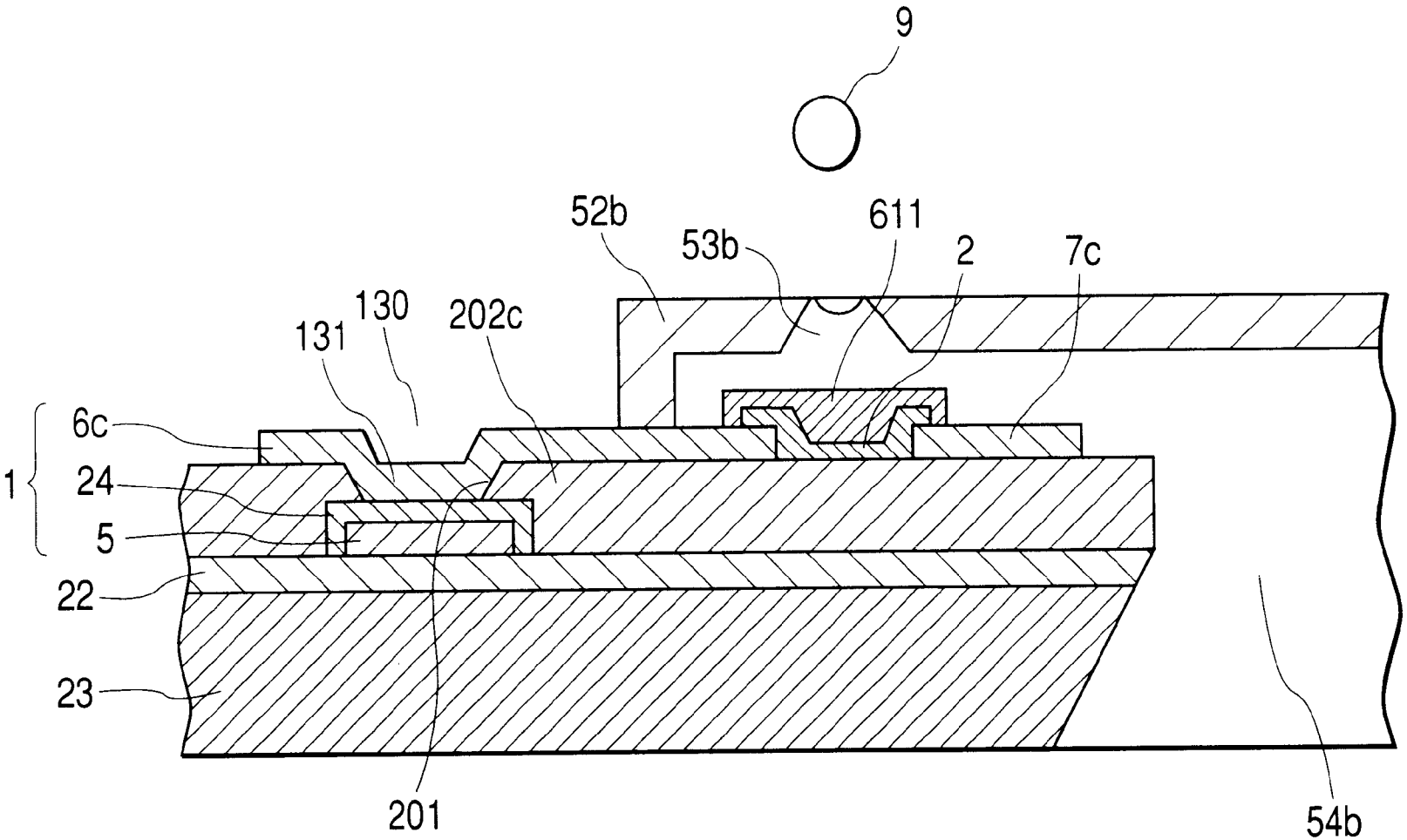
FIG. 8 is a schematic sectional view of the ink jet recording head according to a third embodiment.

FIG. 8 shows a schematic sectional view of the ink jet recording head according to a third embodiment of the present invention. In FIG. 8, the components similar to those of the first and second embodiments are denoted with the same reference numerals, and the description thereof is omitted.

The ink jet recording head has a constitution substantially similar to that of the second embodiment except that the resistance heating element 2 is formed on an insulating layer 202*c*. That is, any hole is not formed in a position with the resistance heating element 2 formed therein in the insulating layer 202*c*, and an upper electrode 6*c* and an information-side electrode 7*c* are connected to the resistance heating element 2 formed on the insulating layer 202*c*.

In the ink jet recording head of the third embodiment, since the resistance heating element 2 is disposed in contact with the insulating layer 202*c*, a part of the heat generated during driving of the resistance heating element 2 is accumulated in the insulating layer 202*c*. That is, the insulating layer 202*c* functions as a heat accumulation layer of the resistance heating element 2, the temperature in the vicinity of the resistance heating element 2 is effectively raised, and the discharged liquid can efficiently and effectively be bubbled. In the constitution of the third embodiment, it is unnecessary to dispose a separate heat accumulation layer, and a manufacturing cost is not increased.

Moreover, the interval between the resistance heating element 2 and the substrate 23 is increased by the insulating layer 202*c* disposed therebetween. Therefore, the heat generated in the resistance heating element 2 is inhibited from being transmitted to the substrate 23 and the temperature rise of the substrate 23 can be inhibited. This can allow an unnecessary heat generated in the MIM element 1 to efficiently escape to the substrate 23. A dispersion in electrical characteristics by the temperature rise of the MIM element 1, or an adverse effect on the constituting members of the MIM element 1 can be suppressed.

Additionally, in the third embodiment, the thickness of the lower layer 22 was set to 0.8 $\mu$m, and the thickness of the insulating layer 202*c* was set to 1 $\mu$m. Moreover, a protective layer 611 constituted of a lamination of 0.8 $\mu$m thick SiN thin film and 230 nm thick Ta thin film was formed on the resistance heating element 2. The protective layer 611 can also be disposed in the first and second embodiments.

(Fourth Embodiment)

Figure 9:
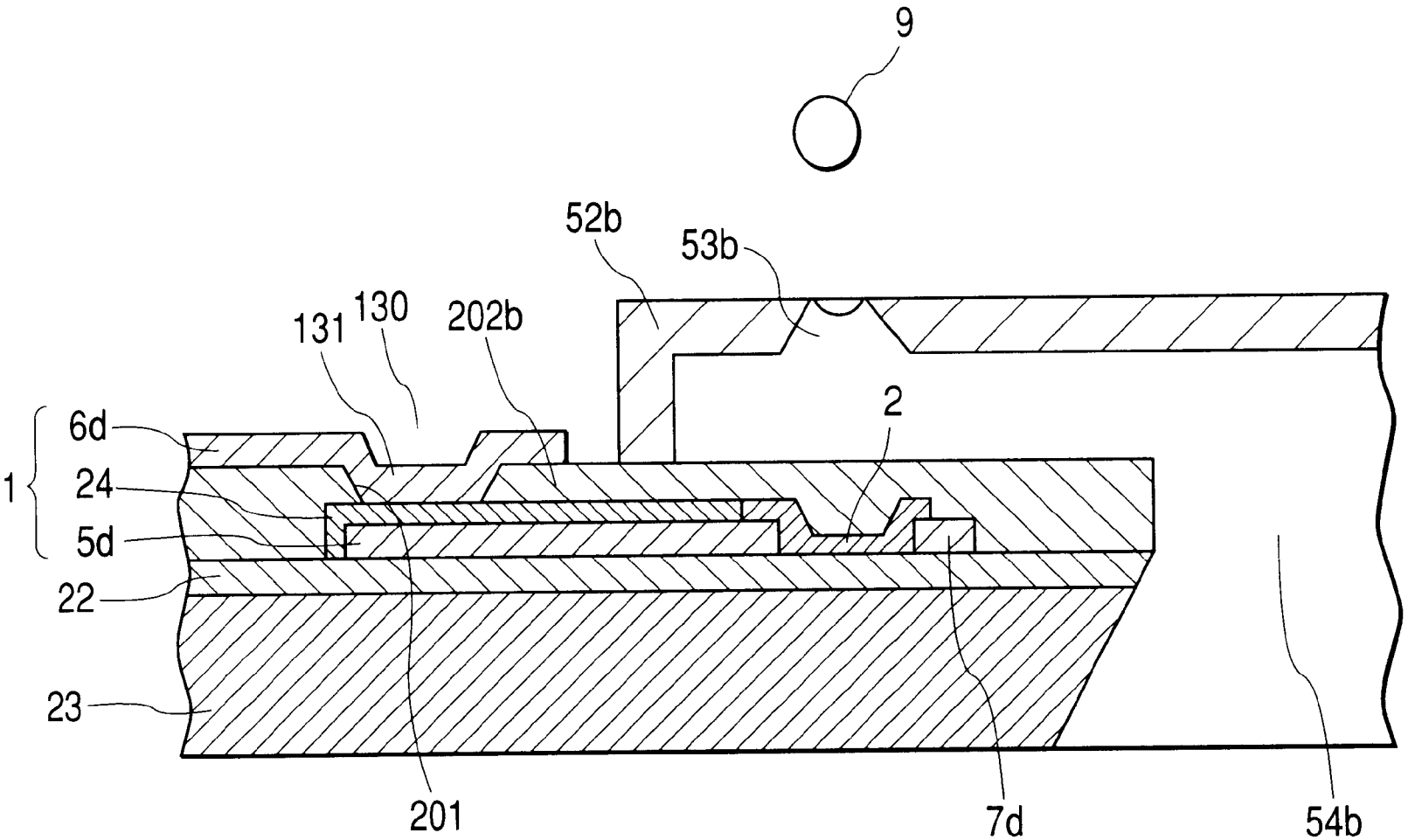
FIG. 9 is a schematic sectional view of the ink jet recording head according to a fourth embodiment.

FIG. 9 is a schematic sectional view of the ink jet recording head according to a fourth embodiment of the present invention. In FIG. 9, the components similar to those of the first to third embodiments are denoted with the same reference numerals, and the description thereof is omitted.

In the ink jet recording head, a lower electrode 5*d* formed on the substrate 23 extends to the resistance heating element 2. An information-side electrode 7*d* is formed opposite to the lower electrode 5*d* on the substrate 23, and the resistance heating element 2 is formed between the lower electrode 5*d* and the information-side electrode 7*d* and in contact with both electrodes on the substrate 23. A connected portion of the lower electrode 5*d* with the resistance heating element 2 has a portion in which the insulating thin film 24 is not formed. The lower electrode 5*d* is connected to the resistance heating element 2 not via the insulating thin film 24. The information-side electrode 7*d* extends in a direction intersecting an upper electrode 6*d*, and forms a common connection portion connected to the respective resistance heating elements 2 arranged in this direction. In the fourth embodiment, the resistance heating element 2 disposed in the matrix form is selectively driven by using the upper electrode 6*d* as the scanning-side electrode and applying the voltage to the upper electrode 6*d* and information-side electrode 7*d*. An insulating layer 202*d* is formed such that the lower electrode 5*d*, resistance heating element 2, and information-side electrode 7*d* are coated with the layer.

In the constitution of the fourth embodiment, the insulating layer 202*d* functions as the protective layer of the resistance heating element 2. Therefore, it is unnecessary to form a separate protective layer of the resistance heating element 2, and the constitution including the protective layer can be realized without increasing the manufacturing cost.

Additionally, in the fourth embodiment, the thickness of the lower layer 22 was set to 1.5 $\mu$m, and the thickness of the insulating layer 202*d* was set to 1 $\mu$m.

(Other Embodiments)

Figure 11:
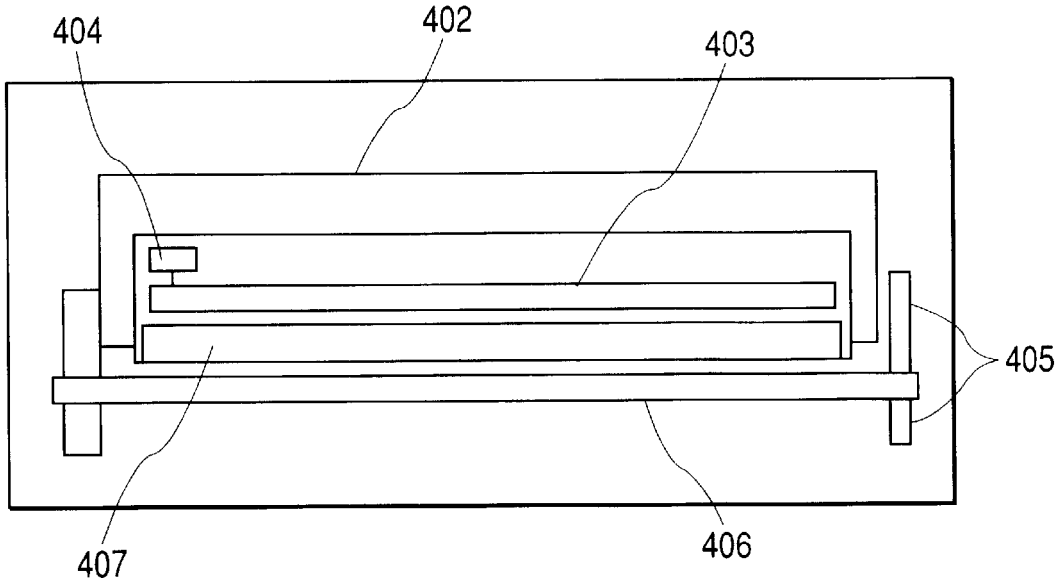
FIG. 11 is a schematic view showing an example of an ink jet recording apparatus according to the present invention, in which the ink jet recording head of the present invention is mounted.

Next, FIG. 11 shows a schematic view of an example of an ink jet recording apparatus in which the ink jet recording head described above in the respective embodiments is mounted.

The ink jet recording apparatus has a constitution in which a paper feed roller 405 driven/controlled by a driving circuit 403 conveys a paper 406 as a recording material. Moreover, in an ink jet recording head 407 controlled by a controller 404, respective discharge ports are disposed opposite to the conveyed paper 406, the ink is discharged from each discharge port in response to a signal from the controller 404, and the image is formed on the paper 406. The ink is supplied to the ink jet recording head 407 from an ink tank 402. The controller 404 disposed in the ink jet recording apparatus inputs a selection potential waveform into one of selected electrodes, and inputs a discharging or non-discharging information potential waveform into the information-side electrode 7 in response to an image signal in order to control the nonlinear element 1 in an on or off state in response to the image signal, and controls discharge and non-discharge of the discharged liquid droplet 9 from the discharge port 53. The ink on the heating means (nonlinear element 1 or resistance heating element 2) to which power is applied as described above is rapidly heated, and the bubble is generated on the heating means (nonlinear element 1 or resistance heating element 2) based on a film boiling phenomenon. The bubble is simultaneously generated over the whole surface of the nonlinear element 1 with a remarkably high pressure. The discharged liquid droplet 9 is discharged via the discharge port 53 by the pressure as described above, and the image is formed on the recording material.

What is claimed is:

1. An ink jet recording head comprising:

a nonlinear element capable of passing a current for generating heat energy in a heating portion to be utilized for discharging ink, said nonlinear element having MIM type current/voltage characteristics such that a resistance value during application of a low voltage indicates a high value regardless of polarity as compared with the resistance value during application of a high voltage, wherein said nonlinear element has an electric field relaxing structure for relaxing generation of a locally strong electric field.

2. The ink jet recording head according to claim 1, wherein said nonlinear element comprises portions of a pair of electrodes disposed opposite to each other, and said electric field relaxing structure is a structure in which an interval between said portions increases toward outer peripheries of said portions.

3. The ink jet recording head according to claim 1, wherein said ink jet recording head causes a film boiling in the ink by the heat energy, and discharges the ink.

4. An ink jet recording apparatus comprising:

the ink jet recording head according to claim 1; and conveying means for conveying a recording material, wherein said ink jet recording head is disposed opposite to said heating portion, and comprises a discharge port for discharging the ink to a recording surface of the recording material.

5. An ink jet recording head comprising:

a nonlinear element capable of passing a current for generating heat energy in a heating portion to be utilized for discharging ink, said nonlinear element having MIM type current/voltage characteristics such that a resistance value during application of a low voltage indicates a high value regardless of polarity as compared with the resistance value during application of a high voltage, wherein said nonlinear element comprises portions of a pair of electrodes disposed opposite to each other, and an interval between outer peripheries of said portions is larger than an interval between any other parts of said portions.

6. The ink jet recording head according to claim 5, wherein said pair of electrodes comprise an upper electrode and a lower electrode, said lower electrode is disposed on a substrate, an insulating thin film is formed on said lower electrode, and said upper electrode is formed on said insulating thin film, and wherein said nonlinear element comprises an MIM element including said upper electrode, said lower electrode and said insulating thin film.

7. The ink jet recording head according to claim 6, wherein an insulating layer is formed between said insulating thin film and said upper electrode, wherein said insulating layer has a first hole in said portions of said upper electrode and said lower electrode, in which said insulating thin film is exposed in the vicinity of a middle of said portions, and which is tapered downwards, and wherein said upper electrode has a downward protrusion having a downward convex shape for engaging in said first hole.

8. An ink jet recording head comprising:

a nonlinear element capable of passing a current for generating heat energy to be utilized for discharging ink, said nonlinear element having MIM type current/voltage characteristics such that a resistance value during application of a low voltage indicates a high value regardless of polarity as compared with the resistance value during application of a high voltage, wherein said nonlinear element has an electric field relaxing structure for relaxing generation of a locally strong electric field.

9. The ink jet recording head according to claim 8, further comprising a heating portion provided in said nonlinear element.

10. The ink jet recording head according to claim 8, further comprising a heating portion provided in a resistance heating element connected in series with said nonlinear element.

11. An ink jet recording head comprising:

a nonlinear element capable of passing a current for generating heat energy to be utilized for discharging ink, said nonlinear element having MIM type current/voltage characteristics such that a resistance value during application of a low voltage indicates a high value regardless of polarity as compared with the resistance value during application of a high voltage, wherein said nonlinear element comprises portions of a pair of electrodes disposed opposite to each other, and an interval between outer peripheries of said portions is larger than an interval between any other parts of said portions.

12. The inkjet recording head according to claim 11, wherein said pair of electrodes comprise an upper electrode and a lower electrode, said lower electrode is disposed on a substrate, an insulating thin film is formed on said lower electrode, and said upper electrode is formed on said insulating thin film, and wherein said nonlinear element comprises an MIM element including said upper electrode, said lower electrode and said insulating thin film.

13. The ink jet recording head according to claim 12, wherein an insulating layer is formed between said insulating thin film and said upper electrode, wherein said insulating layer has a first hole in said portions of said upper electrode and said lower electrode, in which said insulating thin film is exposed in the vicinity of a middle of said portions, and which is tapered downwards, and wherein said upper electrode has a downward protrusion having a downward convex shape for engaging in said first hole.

14. The ink jet recording head according to claim 13, further comprising a heating portion, wherein said heating portion is provided in said nonlinear element, a channel for supplying the ink to the vicinity of said MIM element is formed, and a discharge port for discharging the ink is formed opposite to said MIM element via said channel.

15. The ink jet recording head according to claim 13, further comprising a heating portion, wherein said insulating layer has a second hole in which a part of said substrate is exposed, wherein said upper electrode extends onto said substrate along said second hole, and a resistance heating element connected to said upper electrode is disposed on said substrate in said second hole, said heating portion being provided in said resistance heating element, and wherein a channel for supplying the ink is formed in the vicinity of said resistance heating element, and a discharge port for discharging the ink is formed opposite to said resistance heating element via said channel.

16. The inkjet recording head according to claim 13, further comprising a heating portion, wherein said heating portion is provided in a resistance heating element disposed on said insulating layer and connected to said upper electrode.

17. The ink jet recording head according to claim 13, further comprising a heating portion, wherein said heating portion is provided in a resistance heating element disposed on said substrate and connected to said lower electrode, and said resistance heating element is coated with said insulating layer.

* * * * *